US007089712B2

(12) United States Patent
Talbot et al.

(10) Patent No.: US 7,089,712 B2
(45) Date of Patent: Aug. 15, 2006

(54) APPARATUS AND METHOD FOR PRODUCING A DVD CARRIER ASSEMBLY

(75) Inventors: Keith Andrew Talbot, Lombard, IL (US); Thomas Michael Steffl, Frankfort, IL (US)

(73) Assignee: The Form House, Inc., Bedford Park, IL (US)

( * ) Notice: Subject to any disclaimer, the term of this patent is extended or adjusted under 35 U.S.C. 154(b) by 0 days.

(21) Appl. No.: 10/709,617

(22) Filed: May 18, 2004

(65) Prior Publication Data

US 2005/0257504 A1 Nov. 24, 2005

(51) Int. Cl.
*B65B 1/04* (2006.01)

(52) U.S. Cl. ..... 53/254; 53/238

(58) Field of Classification Search ..... 53/254, 53/564, 50, 238

See application file for complete search history.

(56) References Cited

U.S. PATENT DOCUMENTS

| | | | | | |
|---|---|---|---|---|---|
| 4,300,331 | A | | 11/1981 | Yoshiba | |
| 4,733,519 | A | * | 3/1988 | Harper et al. | 53/456 |
| 4,852,327 | A | * | 8/1989 | Kurkowski et al. | 53/201 |
| 5,163,271 | A | | 11/1992 | Pan et al. | |
| 5,207,050 | A | | 5/1993 | Fulkerson et al. | |
| 5,285,620 | A | * | 2/1994 | Kaye et al. | 53/474 |
| 5,341,624 | A | | 8/1994 | Kaye | |
| 5,502,953 | A | | 4/1996 | Nakayama et al. | |
| 5,608,977 | A | | 3/1997 | Burtch et al. | |
| 5,613,311 | A | | 3/1997 | Burtch | |
| 5,641,063 | A | | 6/1997 | Gambardella et al. | |
| 5,664,405 | A | * | 9/1997 | Perego | 53/457 |
| 6,032,435 | A | | 3/2000 | Zaniboni | |
| 6,035,605 | A | | 3/2000 | Perego | |
| 6,068,116 | A | * | 5/2000 | Bankhead | 206/232 |
| 6,202,839 | B1 | * | 3/2001 | Petersen et al. | 206/308.1 |
| 6,360,890 | B1 | * | 3/2002 | Proffit | 206/308.1 |
| 6,381,922 | B1 | | 5/2002 | Chang et al. | |
| 6,527,500 | B1 | | 3/2003 | Gelardi et al. | |
| 6,536,194 | B1 | | 3/2003 | Minardi | |
| 6,594,969 | B1 | | 7/2003 | Laroche | |

* cited by examiner

*Primary Examiner*—Sameh H. Tawfik
(74) *Attorney, Agent, or Firm*—Blackwell Sanders Peper Martin LLP

(57) ABSTRACT

An apparatus and method are provided for producing an assembly comprising a plurality of digital data storage media carriers attached to a carrier strip. In the production of the assemblies, carriers are positioned for movement in a longitudinal direction of the conveyor system with the carriers being in a row. Carrier strips are secured to the carriers with the longitudinal axis of the assembly and the carrier strips being generally parallel to the direction of movement of the conveyor system. Carriers are deposited onto the conveyor system via a bottom feed depositor which depositor utilizes a pressure differential to help produce positive movement of carriers from a carrier magazine onto the conveyor.

23 Claims, 9 Drawing Sheets

APPARATUS AND METHOD FOR PRODUCING A DVD CARRIER ASSEMBLY

BACKGROUND OF INVENTION

Digital storage media such as CD's and DVD's are very popular for providing such things as entertainment and education to users. It is not uncommon now for such storage media to be sold in multiple unit sets. For example, some movies now come in a set of DVD's, and some music is offered in multiple CD unit sets. These sets can be delivered in a box containing a plurality of "jewel cases," each containing a CD or DVD. The box will generally be decorated with advertising and marketing materials. Another delivery format that has become popular is to have the storage media carriers or trays which are similar to the inside retainer of a jewel case, attached in a series along a carrier strip with each carrier being adapted to retain one or more CD's or DVD's. The carriers may be spaced apart along the strip, allowing for the strip to be folded and allowing the carriers to be stacked one upon another to form a stacked assembly. A closure device or sleeve may be provided to retain the carrier in stack format until opened by the consumer. The consumer may refold the carrier assembly to store it in a stack format for space-saving reasons.

While the carrier assemblies are popular and effective for their intended purpose, the formation of the carrier strips has been problematic. A set may consist of two or any number of carriers of two or more, which number will be determined by the number of storage media units to be included in the set. Currently, an apparatus has been provided for making such carrier assemblies. The apparatus is made by Traying Machine of Minnesota. The problem with the existing apparatus is that they are very expensive and move the carrier strips and carriers attached thereto through the apparatus in a direction transverse to the longitudinal axis of the assembly apparatus. Further, each row of carriers will have to have its own carrier depositors and glue systems which complicates the machine and leaves many of the rows idle when a smaller carrier assembly is being made.

The present invention provides an advance in the art by providing an apparatus which makes the carrier assemblies in an apparatus that can deposit any number of carriers desired in a row and receive thereon a cover strip for securing the carriers together. Only one glue system, one carrier deposit and one cover strip depositor are needed to form the carrier assemblies.

SUMMARY OF INVENTION

The present invention involves the provision of an apparatus usable to form assemblies of digital storage media carriers of any number of carriers in an assembly. The apparatus forms the carrier assembly components and subassemblies and moves them along an assembly path in a direction generally parallel to the longitudinal axis of the carrier assemblies. Simple adjustments may be made to the apparatus to accommodate any number of carriers on a strip. The apparatus also makes the carrier assemblies with the carrier front face down and the inside face of the cover strip down.

The present invention further involves the provision of a method of making carrier assemblies involving the depositing of carriers from a stack of carriers and transferring the carriers through various workstations. The workstations include a glue depositing station in which glue is deposited on each of the carriers. The carriers with the glue are moved to a cover strip station in which a cover strip is applied to the carriers and adhesively bonded thereto. The carriers and carrier assemblies move through the apparatus in a direction generally parallel to the longitudinal axis of the carrier assembly. The cover strip with attached carriers can then be packaged or sent to a device for depositing digital storage media such as CD's or DVD's into the respective carriers and then transferred to a device for folding the assembly to form a stack of the carriers and their contained storage media.

BRIEF DESCRIPTION OF DRAWINGS

FIG. 7 is a perspective view of a carrier assembly shown containing DVDs or the like.

Like numbers used throughout the various drawings designate like or similar parts.

DETAILED DESCRIPTION

Figure 1:
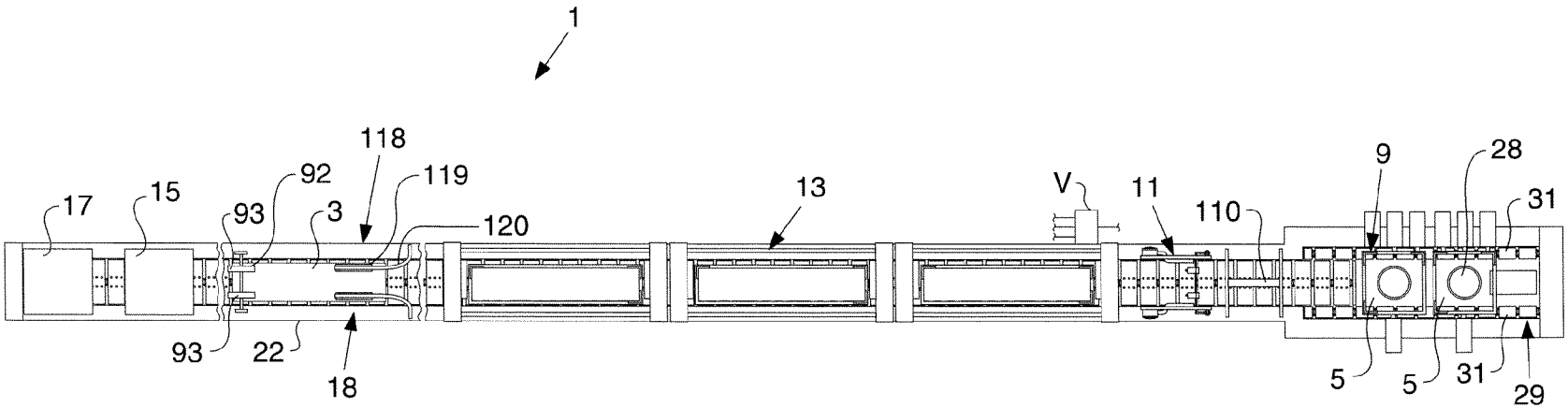
FIG. 1 is an elevation schematic view of an apparatus for making carrier assemblies.
Figure 7:
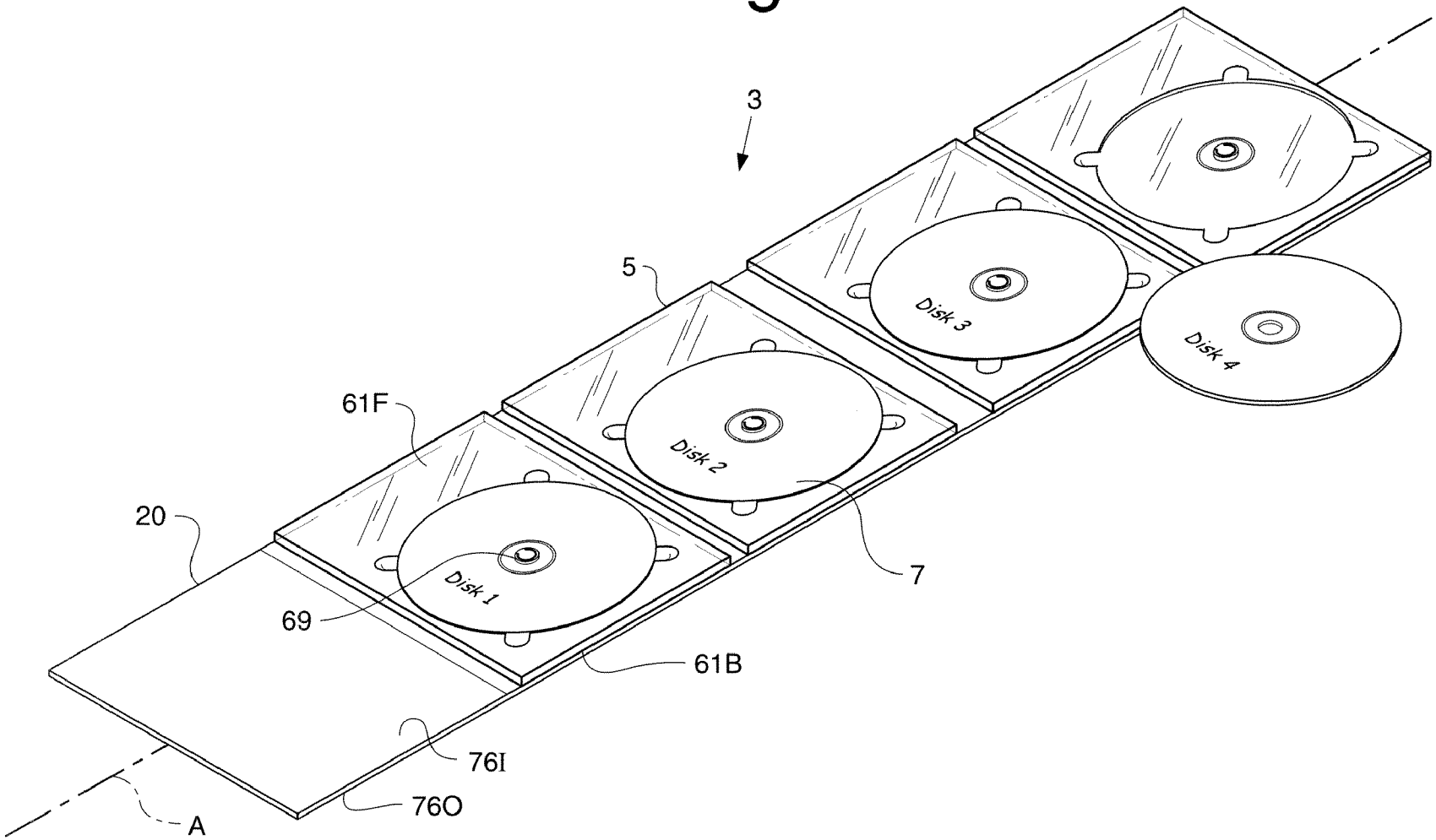
Figure 8:
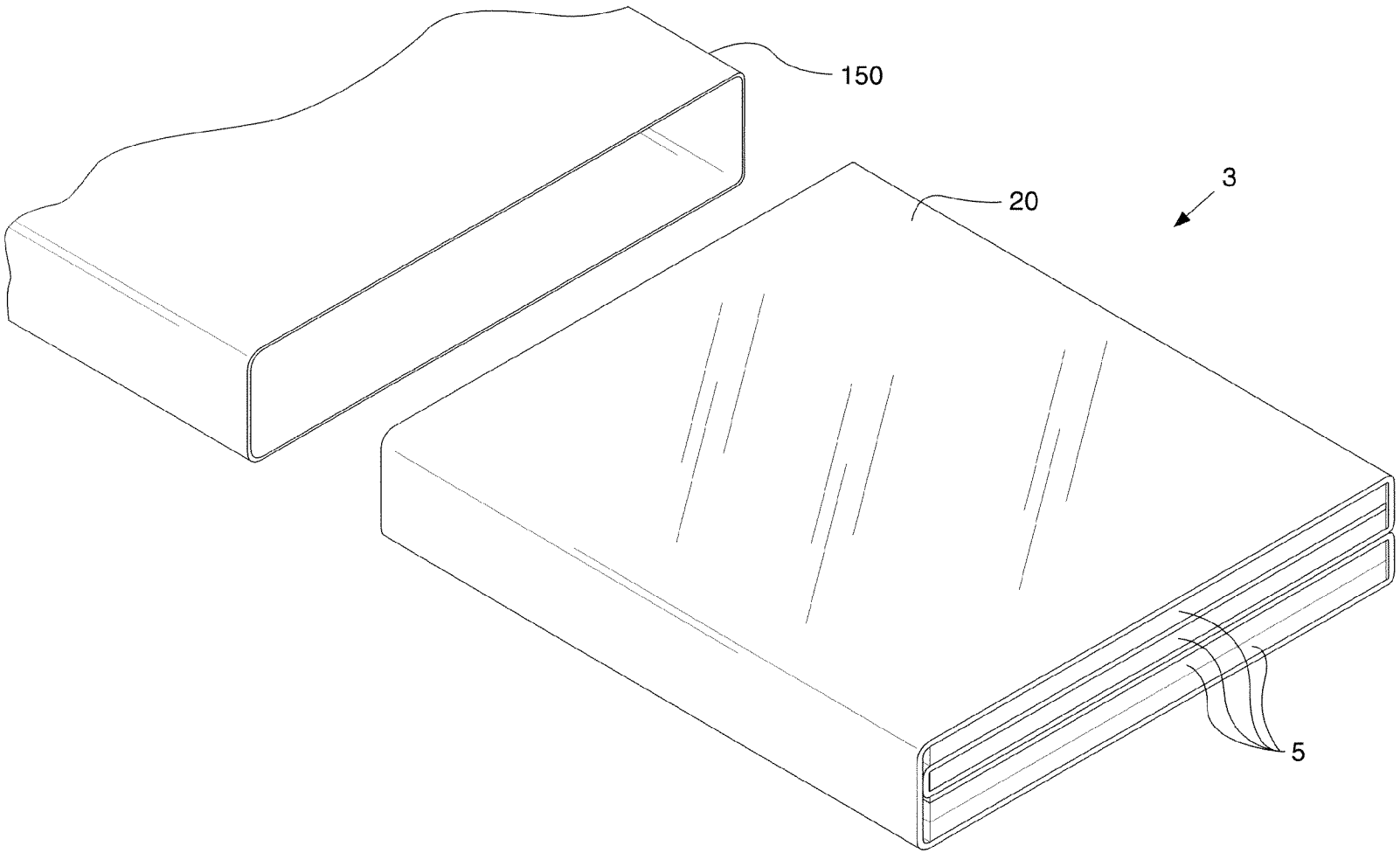
FIG. 8 is a perspective view of a carrier assembly in combination with a packaging sleeve, the carrier assembly being shown in folded condition.

The reference numeral 1 designates generally an apparatus for making carrier assemblies 3 of carriers 5. An assembly 3 is adapted for a plurality of digital storage media units such as CD's or DVD's 7, as best seen in FIGS. 7, 8. The apparatus 1 includes a plurality of work stations including a carrier depositing station 9, a glue applicator station 11, a carrier strip depositing station 13, and optionally, a media unit depositing station 15, and a folding station 17 (FIG. 1). A conveyor system 18 conveys the various components and subassemblies along the apparatus in a generally straight line which is generally parallel to a longitudinal axis A of the assembly 3 and carrier strip 20. The apparatus 1 includes a base 22 adapted for supporting the various components of the stations 9, 11, 13, 15, 16 and the conveyor system 18.

Figure 2:
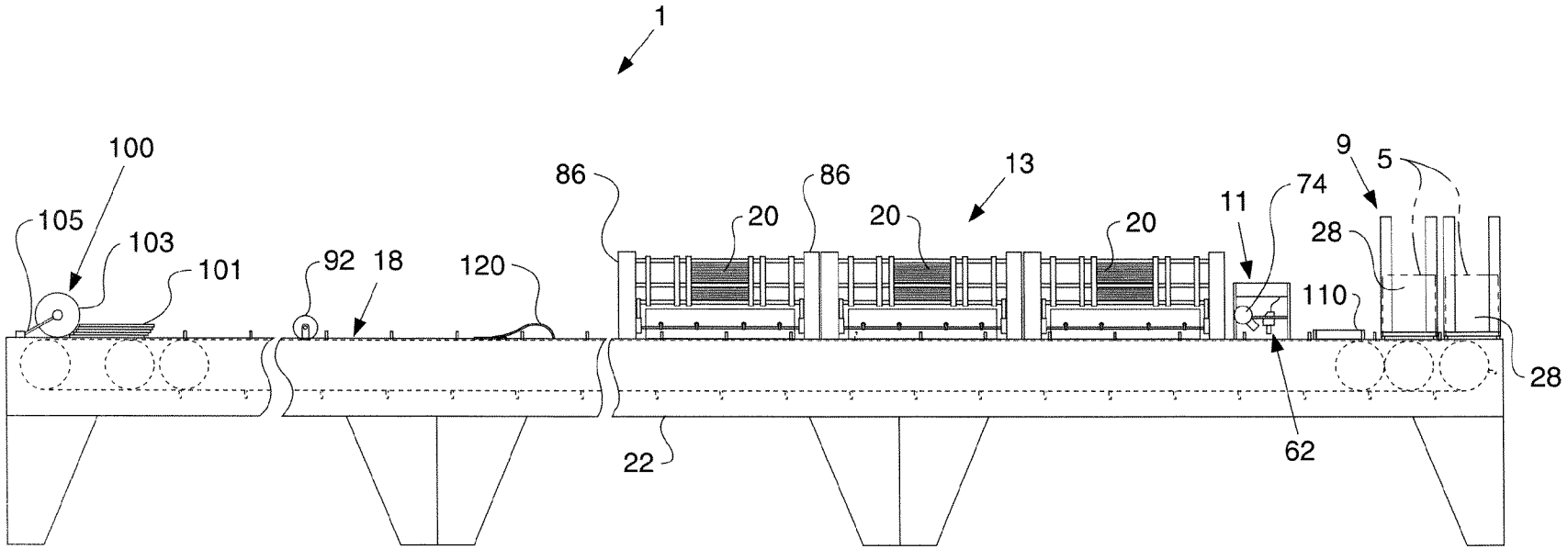
FIG. 2 is a plan schematic view of the apparatus of FIG. 1.
Figure 3:
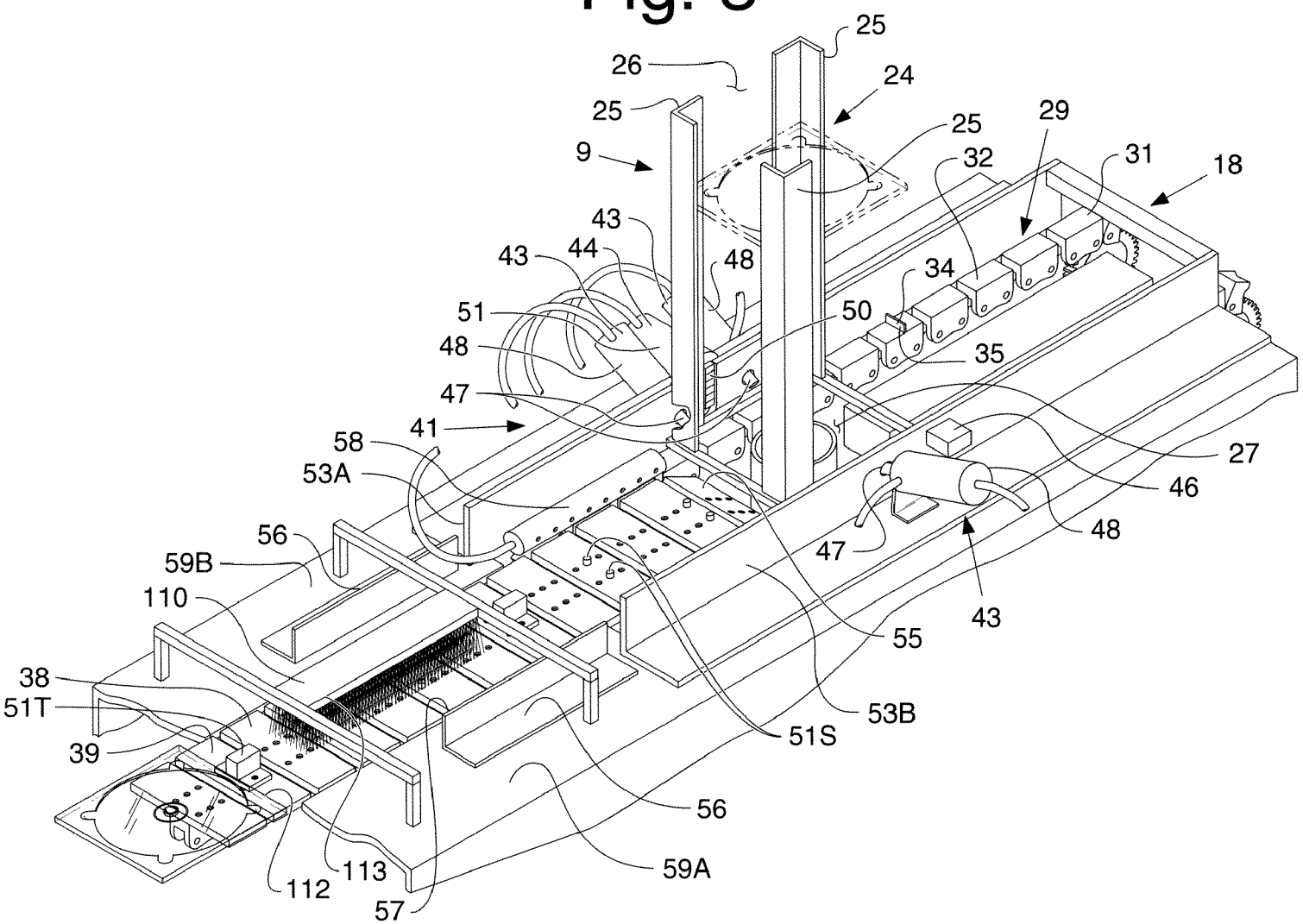
FIG. 3 is a fragmentary prospective view of a carrier depositing mechanism.

The carrier depositing station 9 is best seen in FIGS. 1–3. The station 9 includes a magazine 24 comprising a plurality of spaced apart uprights 25, operable to store a plurality of stacked carriers 5 therebetween, having an open top 26 and an open bottom 27. Carriers 5 may be fed to the stack 28 through the open top 26 and discharged through the open bottom 27. The magazine 24 is positioned above a portion of the conveyor system 18. As seen, the conveyor system 18 comprises a first conveyor portion 29 comprised of spaced-apart conveyor chains 31, each having an upper run 32 for receipt of and transfer of carriers 5 as fed from the open bottom 27 of the magazine 24. Each of the upper runs 32 has fixed thereto carrier pusher devices 34 in the form of ears or lugs projecting upwardly therefrom, each having a shoulder 35 for engaging a trailing edge 36 of a carrier 5. The upper runs 32 of the conveyor portion 29 preferably advances at the same rate as the advancement of the upper run 38 of a second conveyor portion 39. The conveyor portion 39 has a substantial portion thereof downstream of the conveyor portion 29. Both conveyor portions 29 and 39 convey carriers 5 in a direction from the carrier depositing station 9 toward the folding station 17. The downstream end 40 of the conveyor portion 29 has the upper runs 32 declining to a level below the level of the upper run 38 of the conveyor portion 39 to release engagement from the carriers after the carriers are at least initially being conveyed by the upper run 38 of the conveyor portion 39. As seen in FIGS. 1, 2, the station 9 can include a plurality of magazines 24 and respective mechanisms 41 positioned along the longitudinal axis of the conveyor system 18.

The carrier depositing station 9 has a mechanism designated generally 41 for effecting release of a lower-most positioned carrier 5 from the stack 28 onto the upper runs 32 at desired times relative to the position of the ears 34 on the upper runs 32. As best seen in FIG. 3, the release mechanism 41 includes a support device, designated generally 43, which selectively retains the lower-most positioned carrier 5 within the magazine 24. The mechanism 41 also includes the device designated generally 44 which is operable to retain the carriers above the lower-most positioned carrier 5 within the magazine while the lower-most carrier 5 is being released from the magazine to move downwardly and onto the conveyor portion 29. A control device 46 such as an electric eye, a micro switch or the like, may be provided to detect the presence of an ear 34 and activate the mechanism 41 for the release of a lower-most positioned carrier 5 at the desired time. Release may also be triggered by a timer or synchronized to the movement of the conveyor system 18 components. The support device 43 includes a plurality of fingers 47, at least one of which is on each side of the conveyor portion 29 extending under the respective side edge of the carriers 5 in the magazine 24. Retraction of the fingers 47 as for example, by contraction of a linear motion device such as an air cylinder 48, will release the lower-most carrier 5 for depositing. Extension of the fingers 47 to positions under the carriers 5 will selectively retain the carriers 5 in the magazine 24. To prevent release of carriers 5 above the lower most positioned carrier 5, the retention device 44 is utilized. The retention device 44 includes a retainer element 50 selectively movable into and out of engagement with one or more carriers 5 positioned above the lower-most carriers 5 and when engaged with the carriers 5, applies force transversely across the carriers whereby all but the lower-most positioned carrier is frictionally retained within the magazine 24. The retainer 50 is mounted to a linear motion device 48, e.g., an air cylinder which extends forward just prior to the retraction of the fingers 47 and moves backwards or retracts releasing the applied force on the carriers when the fingers 47 are back under the carriers in the magazine 24. Release of the carriers 5 from engagement with the retainer 50 allows the stack of carriers to move downwardly to again present a new lower-most positioned carrier. The release of a carrier 5 for depositing on the conveyor portion 29 is effected by alternating extension and retraction of the fingers 47 and the retainer 50. An ear 34 engages the trailing edge 36 of a carrier, and moves it forward to the conveyor portion 39. The carrier 5 that has been deposited is then transferred to the conveyor portion 39 as it advances toward the downstream stations. Sequential depositing of carriers 5 forms a row of carriers which now has a longitudinal axis generally parallel to the upper run 38.

Means is provided to fix the locations of the carriers 5 on the upper run 38 and to ensure conveying of the carriers by the conveyor portion 39 and to help position the strips 20 on the carriers. As shown, shoulder forming members in the form of upstanding lugs or ears 51 are secured to the conveyor portion 39. The location of ears 51 on a conveyor portion 39 will set the desired spacing between the carriers 5 deposited on the conveyor portion 39 at pre-determined spacings in the longitudinal direction of the conveyor portion 39, as determined by the particular fold pattern utilized for the assembly 3. There are two forms of ears 51, short ears 51S and tall ears 51T. The short ears 51S have a height less than the thickness of the carriers 5 and the tall ears 51T have a height greater than the combined thicknesses of the carriers 5 and strips 20.

Side rails 53A, B are positioned on opposite sides of the conveyor portion 39 to assist in maintaining the deposited carriers on the conveyor portion 39 aligned. After exiting from under the magazine 24, and while on the entry end 55 of the conveyor portion 39, mechanism, designated generally 56, is provided for aligning the carriers transversely of the conveyor portion 39. The mechanism 56 may include a plow or a pair of plows. In the illustrated structure, the aligning mechanism 56 includes an air manifold 58 operable to project one or more streams of air at the carriers 5 passing thereby to ensure the carriers are down on the upper run 38. It is preferred that the top surface 57 of the upper run 38 is above the surfaces 59 A, B on the opposite sides of the upper run to prevent marring of the carriers through contact between the surfaces 59 A, B and the front face 61F of the carriers 5. The carriers 5 are deposited front face 61F down and on the conveyor system 18 and back face 61B up. It is preferred that the top surface 57 of the upper run 38 is above the surfaces 59 A, B on the opposite sides of the upper run to prevent marring of the carriers through contact between the surfaces 59 A, B and the front face 61F of the carriers 5. The longitudinal positions of the carriers 5 on the conveyor portion 39 are fixed each by a respective pusher ear 51. Additional guides may also be provided to ensure continued alignment of the carriers 5 as they travel along the upper run 38 through the various stations 11, 13, 15, 17.

Figure 5:
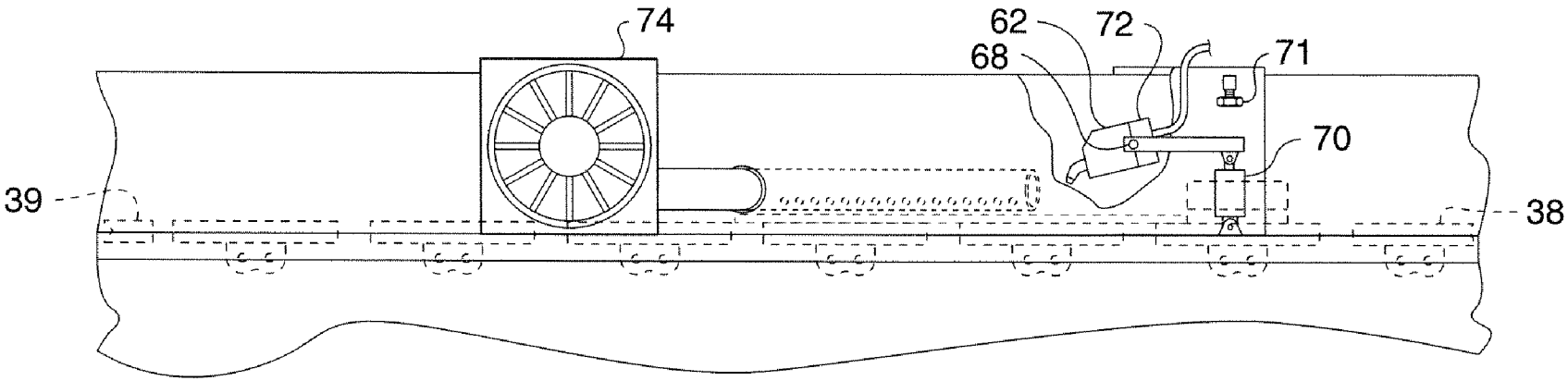
FIG. 5 is a fragmentary side elevation view of the adhesive applying station.

The carriers 5 on the upper run 38 are transferred by the conveyor portion 39 to the glue station 11. The glue station 11 includes one or more glue depositors 62 positioned above the upper run 38 and operable to apply at selected locations, predetermined quantities of glue on the back sides 61B of the carriers 5 passing thereunder. The glue is preferably of a hot melt type and is at a temperature adequate to provide the appropriate viscosity and work time prior to the application of a carrier strip 20 to the carriers 5, as described below, to form an assembly 3. The glue station 11 includes at least one glue depositor 62 which can comprise a single head with multiple outlets, multiple heads each with single outlets, or a combination thereof. The glue heads 64 have a generally downwardly directed opening for the dispensing of glue therefrom onto the upward facing back 61B. The glue heads 64 are connected to a source 66 of glue which supplies glue to the glue head outlets via a pressure feed system which is part of the glue source 66. Valve means is provided to intervallicly dispense glue on a controlled sequence when the carriers 5 are positioned under the glue heads 64. Each glue head 64 may deposit more than one spot of glue on each carrier during movement of the upper run 38 and/or movement of the glue depositors 64. Initiation of glue depositing is by a sensor 67 adapted to sense the leading edge of a carrier 5 and then through a timer controller effect depositing of the glue. The spacing between the dispensing portion of the glue head 64 and the upper surface of the carrier 5 onto which the glue is deposited may be adjustable by any suitable means. The glue head 64 may be fixed in position, maintaining a constant space between it and the upper surface of the carrier 5 thereunder, or may be movable to selectively increase the spacing between the glue head 64 and the upper surface of the carrier 5. As seen, the glue heads 64 are mounted on a shaft 68 which is movable via a linear motion device such as an air cylinder 70 and can have the position thereof adjustable relative to the upper surface of the carrier 5 via an adjustable stop 71, FIG. 5. Other means for moving the heads 64 can be provided if desired. It has been found that glue heads may be fixed in one position for effective depositing. The transverse spacing of the glue heads 64 may also be adjusted by having a releasable clamp 72 securing each of the glue heads 64 to the shaft 68. A particularly preferred glue head 64 is a BF glue head made by ITW Dynatec of Hendersonville, Tenn. The glue source 66 is preferably a Dynamini made by ITW Dynatec. Such glue depositors are well known in the art.

The applied adhesive, may still be in contact with the glue head 64 after depositing. Advancement of the carriers 5 from the glue station 11 can often times lead to the glue remaining attached both to the carrier 5 and the glue head. When the carrier advances, the glue will stretch and tail until severed. It has been found that through the application of a hot air stream provided by a hot air source 74, such as heat guns, can heat the glue to a temperature to reduce or prevent stringing or tailing of the glue during movement of a carrier out of the glue station. A hot wire, shown in phantom at 75 (FIG. 4), may also be used alone or in combination with the heat guns 74.

Figure 6:
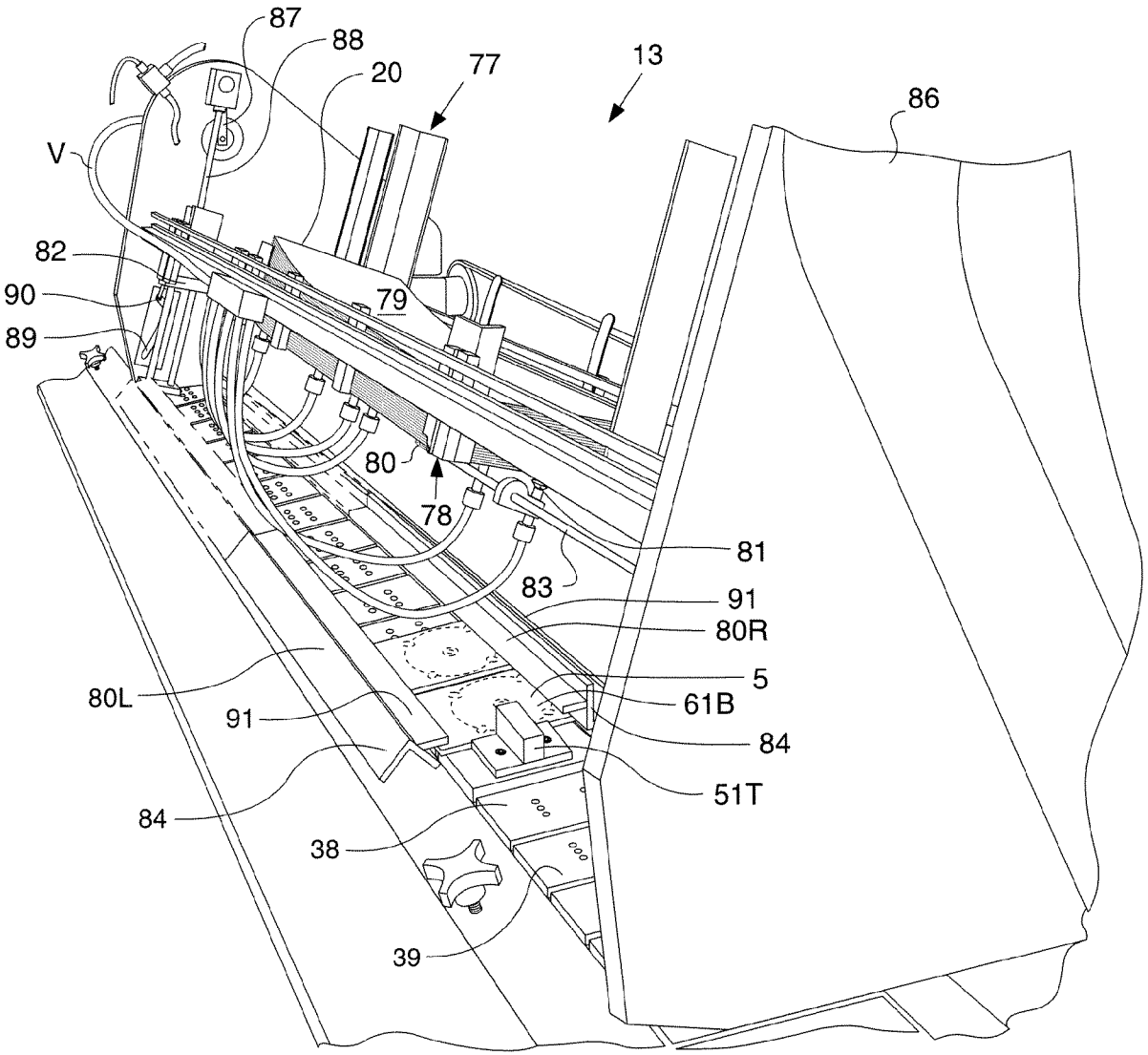
FIG. 6 is a fragmentary prospective view of a first form of carrier depositing station looking from an upstream position toward a downstream position.

After the appropriate glue spots are applied to the carriers 5, the carriers are transferred via the conveyor portion 39 to a carrier strip applying station 13 best seen in detail in FIG. 6. Such applicators are well known in the industry. As shown, the strip applying station 13 includes one or more magazines 77 for storing a plurality of carrier strips 20 as discreet carrier strips pre-cut to the correct dimensions and shapes. When more than one magazine 77 is present they are positioned along the longitudinal axis of the conveyor system 18. The carrier strips 20, as shown, are positioned to have an inside face or surface 761 of one carrier strip facing either generally upward and an outside face 760 facing generally downwardly. The strip applicator 78 includes a device for separating a bottom positioned carrier 5 from the stack 79 thereof in the magazine 77. The strips 20 are selectively held in the magazine 77 by fingers 80 extending under the strips 20. A preferred applicator mechanism is a double hopper pick and place feeder made by Mactronics. The applicator includes one or more suction devices 81 connected to a source or supply of vacuum V. Suction devices 81 are mounted on a transfer mechanism 82 which is operable to move the suction devices 81 to a position adjacent to and having their exposed faces generally parallel to the inside face 761 of the carrier strips 20 in the magazine 77. The suction devices 81 will engage the bottom-most carrier strip 20, and through additional movement of the transfer mechanism 82, remove the bottom-most strip 20, rotate the carrier strip 20 approximately 145° to an orientation where it is generally parallel to the plane of the upper run 38 of the conveyor portion 39 and also to be generally parallel to the bottom faces 61B of the carriers 5. The transfer mechanism 82 is operable to lower its retained carrier strips 20 downwardly and ultimately into engagement with the upwardly facing back faces 61B of the carrier 5 for contact with the glue applied thereto. The transfer mechanism 82 first places the carrier strips 20 onto supports 80L and 80R such as rails positioned on opposite sides of the upper run 38 of the conveyor 39. The supports 80 are in the form of structural members with one flange 84 of each secured to support portions of the conveyor system 18. The supports 80 also include shelf-forming projections 91 projecting inwardly from the flanges and over the upper run 38. The strips 20 are placed onto the supports 80 and in particular the projections 91 which will retain a deposited carrier strip 20 above underlying carriers 5 and spaced from the back face 61B. A corresponding ear 51T will engage the trailing edge of a respective strip 20 and move it downstream in indexed fashion with the underlying carriers 5. In the vicinity of the downstream end of the strip depositing station 13, the supports 80 terminate allowing the strip 20 to move onto the faces 61B of the carriers 5. The flanges 84 will help maintain lateral positioning of a strip 20 relative to its respective carriers 5. The just described supports 80 permit both lateral and longitudinal positioning of the strips 20 to the carriers 5. After application of the strip 20 to the supports 80, the vacuum is released and the transfer mechanism 82 raises the suction devices 81 out of engagement with the strip 20, allowing movement of the carriers 5 forward toward the next work station and downstream engagement with a respective strip 20 positioned thereover. The transfer mechanism 82 is then operable to pick another carrier strip 20 for application to a new series of carriers 5 being fed along by the conveyor portion 39. The transfer mechanism 82 includes a bar 83 on which the suction devices are mounted. Valve means (not shown) control the negative pressure within the suction devices 81 and the tubes connecting them to the source of vacuum to release the negative pressure on the strip 20 to effect its retention and release at the desired time. The movement of the transfer mechanism 82, and hence the suction devices 81, is accomplished through a drive mechanism powered by a drive 86 connected thereto and linked to the conveyor drive to synchronize the movement of the conveyor 39 and the transfer mechanism 82. As seen, the drive 86 includes an eccentric arm 87 on each end of the device which when the arm 87 rotates, lifts the links 88 and hence the bar 83 upwardly. The bar 83 and the suction devices 81 thereon are rotated through the use of a cam slot and cam follower 89, 90, respectively. A plurality of magazines 77 (FIGS. 1 and 2) may be provided to allow for simultaneous application of a plurality of carrier strips 20 at a time. The additional magazines 77 are shown in a row generally parallel to the longitudinal axis of the conveyor 39. Only one magazine 77 is shown in FIG. 6.

Once the carrier strip 20 is placed on the respective carriers 5 after leaving support by the supports 80 on the carriers 5 and contacts the adhesive, the pre-assembly is transferred out of the strip applicator station 13 via movement of the upper run 38 of the conveyor 39, FIG. 6. A mechanism 92 can be provided to provide force on the glue by applying force to the carrier strip 20 and/or carriers 5 to ensure firm adhesive engagement between the carriers 5, glue, and carrier strip 20 and also press the glue thinner to ensure a uniform thickness of glue in the finished assemblies 3. As seen, the mechanism 92 includes a pair of rollers 93 positioned over the upper run 38 which is positioned to engage the carrier strip and provide a downward force thereto to effect thinning of the glue spots and the adhesive engagement between the glue, carrier strip 20 and carriers 5. The roller 93 extends generally transversely across the upper run 38.

Figure 4:
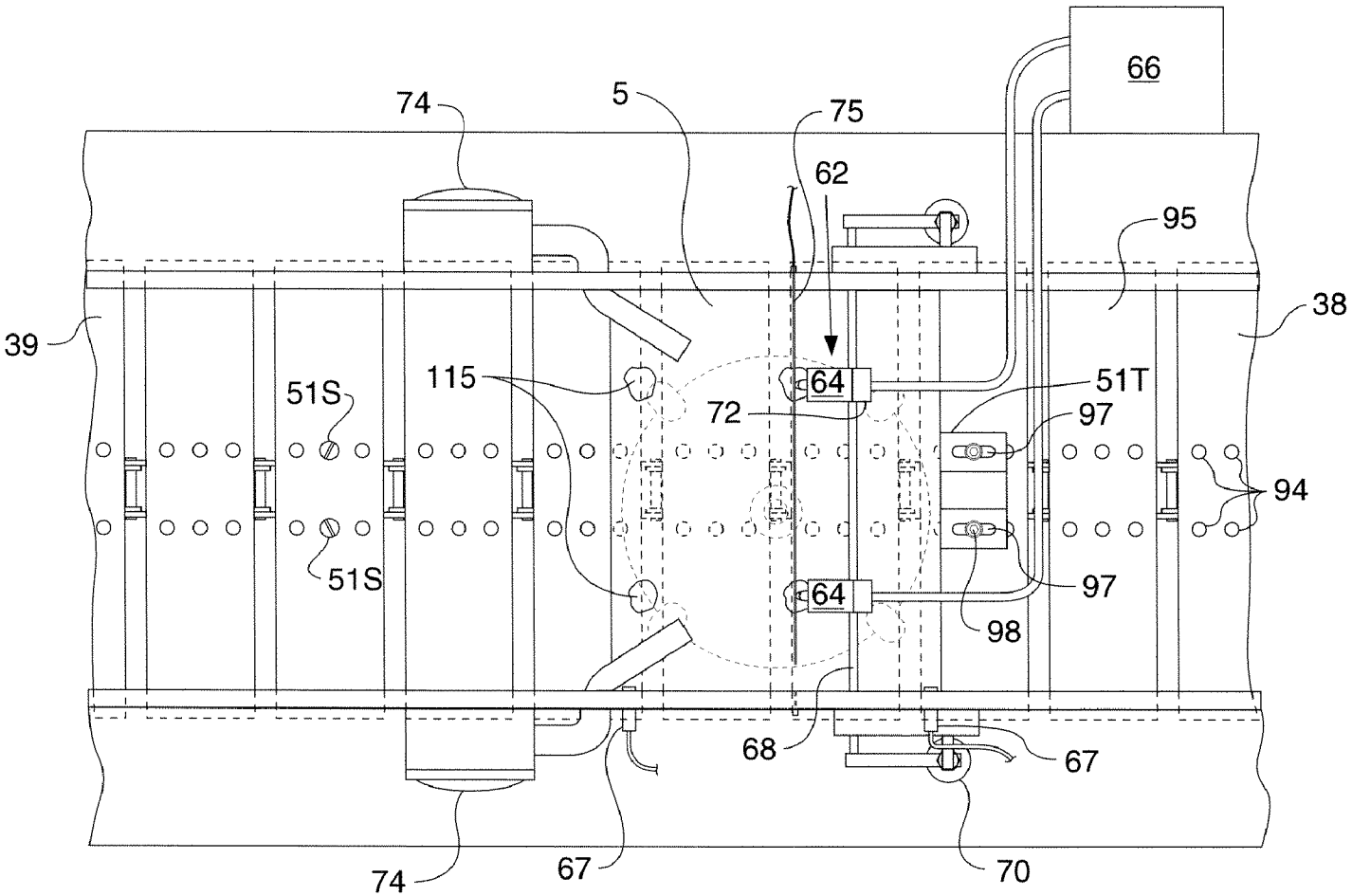
FIG. 4 is a fragmentary plan view of the adhesive applying station.

The spacing of the ears 51 on the conveyor portion 39 fixes the position and spacing of the carriers 5 relative to one another to ensure the proper spacing within the assembly 3 and the position of a strip 20 to the carriers 5 to which it is to be attached. As seen in FIG. 4, the ears 51T are secured to conveyor flights or links 95 in a manner to adjust their longitudinal positions. The securement of the ears 51T may be by any suitable means. As shown, a plurality of threaded holes 94 are provided in the links 95 of the conveyor portion 39. The ears 51T have flanges with elongate slots 97 and threaded fasteners 98 extend through the slots 97 and the flanges 96. The use of the elongate slots 97 permits longitudinal adjustment of the position of the ear on a link 95, and the links may also be selected onto which the ears are secured providing adjustment between ears 51T and the ears 51S on the conveyor portion 39. Other means of securing the ears 51T in predetermined locations on the conveyor portion 39 can be provided as are well known in the art. The ears 51S may be in the form of threaded pins each attachable in a desired threaded hole 94 at a desired longitudinal location on the conveyor portion 39.

After exiting the strip applying station 13, the assemblies 3 may be transferred optionally to a station 15, for depositing storage media 7 such as CDs or DVDs in a prearranged sequence in each of the carriers 5 of an assembly 3. After passing by the mechanism 92 a brake mechanism 100 is provided to slow down the advancing carrier assemblies 3 and start a shingled stack 101. This feature would not be needed if stations 15 and/or 17 are included. The brake mechanism is operable to form a shingled stack 101 of carrier assemblies 3 to assist packaging the assemblies 3 immediately after manufacturing. The brake mechanism 100 includes a rotatable wheel 103 mounted on a pivot arm 105. The wheel is positioned generally centrally of the conveyor portion 39. Also, optionally, a folding station 17 may be provided which can fold the assemblies 3 with a contained media 7 therein to form a final folded assembly, as best seen in FIG. 6, for subsequent distribution and sale. Depositing storage media and folding can also be accomplished manually, if desired.

The present invention is better understood by a description of the operation of the apparatus 1 and a description of the method of making the carrier assemblies 3. Upon a timed sequencing, carriers 5 are deposited on the first conveyor portion 29. The carriers are deposited in a manner and are conveyed by the conveyor 39 in spaced apart relationship in a generally straight line row with the row having a longitudinal axis generally parallel to the longitudinal axes of the conveyor portions 29 and 39. The carriers 5, as shown, are generally rectangular in shape having side edges, a front leading edge and a rear trailing edge. The side edges are generally aligned during conveying and operations being performed thereon at the downstream work stations 11, 13, 15 and 16. The carriers 5 are deposited in a front face 61F down orientation wherein a storage media retainer 69 will be exposed in the final assembly 3 to receive a storage media unit 7. The ears 51 position the carriers 5 at the desired spacing between the carriers. A positioning device 110 is provided to ensure contact of the carriers 5 at their trailing edges 112 with a respective ear 51. As shown, a brake in the form of a brush 113 is mounted to engage a carrier to stop the carriers forward progress until an ear 51 is engaged. The spacing will be determined by the fold pattern desired for the carrier assemblies 3. The aligned and spaced carriers 5 are transferred to the glue depositor station 11 and the appropriate number of glue spots 115 are deposited on the upwardly facing back face 61B of the carriers 5. It is preferred that at least two glue spots be applied to each carrier 5 and preferably four spots, one adjacent each corner of the generally rectangular carrier 5. Throughout conveying and processing, through the carrier strip applying station 13, the carriers 5 have the storage media retainers 69 downwardly facing since this will become the exposed face after application of the carrier strips 20. The carriers 5 are transferred along the conveyor portions 29 and 39 with continuous motion with no pause in movement at the processing stations through at least the stations 9, 11 and 13. As predetermined, a number of carriers 5 are positioned within the station 13 to receive their respective carrier strip 20. The number of carriers used to form an assembly 5 can be readily changed and accommodated within the apparatus 1. As described above, one or more strips 20 can be applied at a time. After the predetermined number of carriers 5 are positioned within the station 13, one or more carrier strips 20 is removed from a magazine or magazines 77 as desired. The carrier strips 20 and the magazines 77 have their longitudinal axes generally parallel to the longitudinal axes of the conveyors 29, 39 and the row of carriers 5 on the conveyors 29, 39. A carrier strip 20 is removed from the magazine 77 and placed onto the supports 80 above the desired carriers 5 wherein the side edges of the carriers are also generally parallel to the side edges of the respective carrier strip 20. The longitudinal spacing of the carriers 5 is maintained at the pre-determined spacings during application of the carrier strip 20 to the carriers 5. After application of a carrier strip 20 to its respective carriers 5 after leaving support by the supports 80, it is preferred to apply a downward force to the carrier strip 20 to ensure adhesive engagement between the carrier strip 20, the carriers 5 and the applied glue. Preliminary downward force may be applied to the assemblies 3 prior to reaching the mechanism 92 by drags 118 in the form of a brush or other friction device 119 mounted on a spring arm 120. This also ensures contact of the carriers 5 with the ears 51 after exiting the station 13. The carrier strip 20 is thus adhesively bonded or secured to its respective carriers 5. The force may be applied by the mechanism 92 as described above and the drags 119. If a heat set adhesive is used, the adhesive is allowed to cool completing the bonding process. If a curing or drying glue is used, time needs to be provided to accomplish the bonding between the carrier strip 20 and its respective carriers 5. Contact glue may also be used if desired. It is preferred that the adhesive applied be a permanent adhesive and not of the restick type adhesive. A preferred adhesive is hot melt 70007A-701 made by National Starch of Chicago, Ill. It is preferred that prior to the formation of the carrier assemblies 3 that the carrier strips 20 be printed with indicia such as marketing materials and informational materials about the contents of the assembly 3 when sold at retail. If printed indicia is provided on the side onto which the carriers 5 are secured to the carrier strip 20, it is important to maintain proper positions of each the carriers 5 in order to ensure visibility of some of the indicia thereon. After the formation of the carrier assemblies 3, they may be optionally packed and shipped to a subsequent processor for the insertion of the storage media into each of the carriers 5 and subsequent folding. In this case, a packaging line may be provided at the downstream end of the conveyor 39 and downstream of the carrier strip applicator station 13. Packaging can be by packaging machinery or manually by workers. Optionally, the apparatus 1 may be provided with a storage media insertion station 15 to insert the desired storage media into each of the carriers 5. To do this, the carrier assemblies 3 will be rotated about their longitudinal axis, e.g., about 145° to have the carriers 5 upwardly facing and the retainers 69 exposed. The carrier assemblies 3 with inserted storage media may then optionally be packed and sent to a subsequent processor for folding and packaging for shipment to distribution points. Optionally, the apparatus 1 may be provided with a folding apparatus 16 to fold the carrier assemblies 3 to form the final retail unit. The final retail unit may be inserted into additional packaging 150 or may be provided with its own closure device to provide its own integral securement FIG. 8. The inserting of storage media units and folding may be done by an apparatus or may optionally be done manually, if desired.

One of the advantages of the present invention is that the carriers and the subassemblies of the carrier assembly 3 move through the apparatus in a direction generally parallel to the longitudinal axis of the finished assembly 3 and preferably in a straight line from the depositing station 9 through the folding station 16. This allows for the manufacture of carrier assemblies 3 of any selected number of carriers 5.

Figure 9:
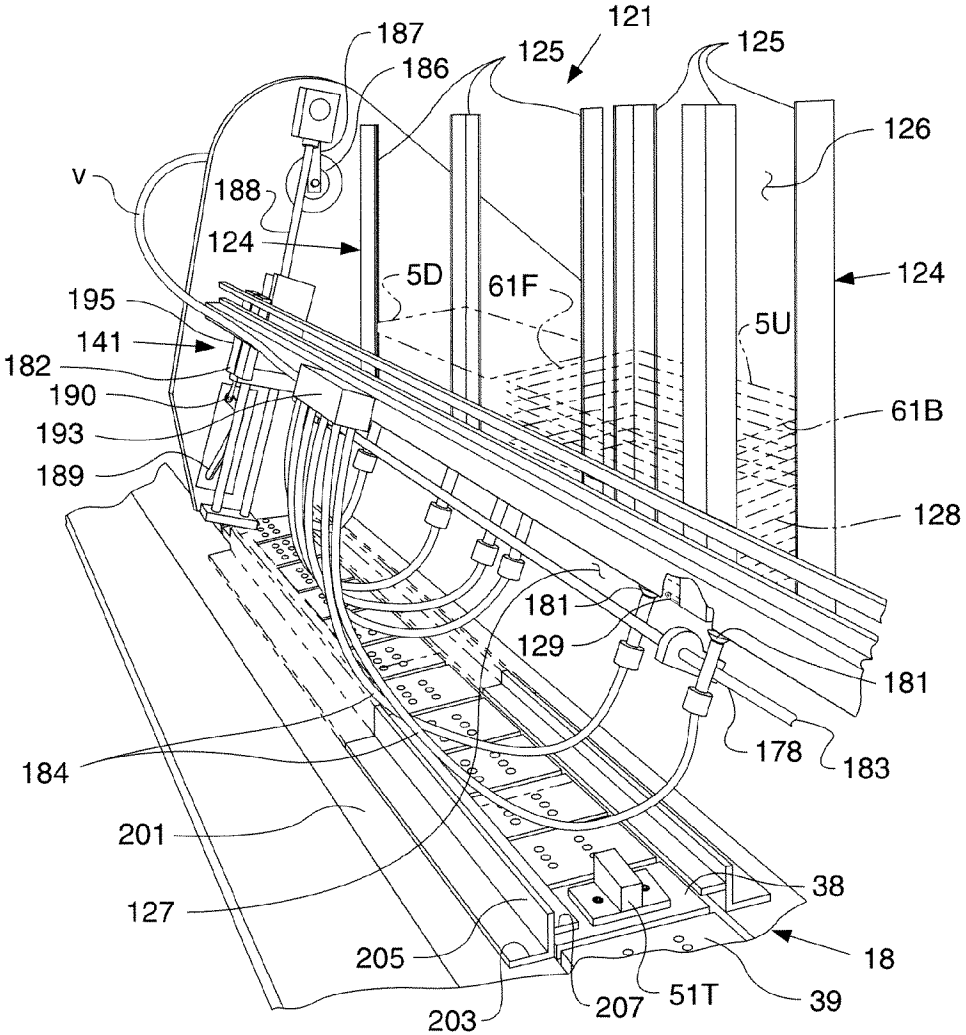
FIG. 9 is a fragmentary perspective view of a modified form of strip depositing station looking from an upstream end toward a downstream end.

FIG. 9 illustrates an alternative embodiment of the present invention. It provides an alternative construction to the construction to the carrier depositing station shown in FIGS. 1–3. In the modified carrier depositing station 121 there are one or more magazines 124 compromised of a plurality of spaced apart upright 125 operable to store a plurality of stacked carriers 5 therebetween. Each magazine 124 has an open top 126 and an open bottom 127. The plurality of resilient fingers 129 are positioned adjacent to the open bottom 127 to releasably retain the carriers 5 in the magazine 124. The magazine 124 is positioned above a portion of a conveyor system 18 for feeding carriers 5 to the conveyor system 18. The depositing station 121 has a mechanism designated generally 141 for effecting removal of a lowermost positioned carrier 5 from the stack 128 and placing onto the upper run 38 at desired times. The removal mechanism 141 is similar to the applicator 78 as described above. In the operation of the depositing station 121 the front faces 61F are up and the back faces 61B are down, just the opposite of that described above for the first embodiment of the depositor 9. The carrier applicator 178 includes a device for separating the bottom-most positioned carrier 5 from a stack 128 thereof in the magazine 124. The applicator 178 includes one or more suction devices 181 connected to a source of vacuum V. The suction devices 181 are mounted on a transfer mechanism 182 which is operable to move the suction devices 181 to a position adjacent to and having their exposed faces generally parallel to the back face 61B. The suction devices 181 will engage the bottom-most carrier 5 and through additional movement of the transfer mechanism 182 remove the bottom-most carrier 5, rotate the carrier 5 approximately 180° to an orientation generally parallel to the plane of the upper run 38 of the conveyor portion. The transfer mechanism 182 is operable to lower a retained carrier 5 downwardly for ultimate engagement with the conveyor portion 39 for movement to processing stations downstream. In the illustrated device, the transfer mechanism simultaneously lowers two carriers 5. The downstream carrier 5 will be deposited directly onto the conveyor portion 39. The upstream carrier 5 will be deposited onto rails at an elevation slightly above the upper run 38. The rails 201 are secured to a portion of the conveyor support and have a generally horizontal flange and a generally vertical flange 203, 205 respectively. Secured to and projecting inwardly from a respective flange 205 support flanges 207. The flanges 207 terminate before they reach a position underlying the downstream magazine 124. The ear 51T is sufficiently high that when it passes between the flanges 207 it will engage a trailing edge of a carrier 5 positioned thereon and move it along the rails for ultimate deposit onto the upper run 38 when the rails 207 are no longer in a position under the deposited carrier 5. After depositing of a carrier 5, the vacuum is released and the suction devices 181 and the transfer mechanism 182 raises the suction devices 181 out of engagement with the carrier 5 allowing movement of the deposited carriers downstream via the conveyor portion 39 as described above. The transfer mechanism 182 is operable to remove another carrier 5 for depositing on the conveyor portion 39. The transfer mechanism 182 includes a bar 183 on which the suction devices 181 are mounted. Valve means 193 control the negative pressure within the suction devices 181 and the tubes 184 connecting them to the source of vacuum to release the negative pressure on the carriers 5 to effect their retention or release at the desired times. The movement of the transfer mechanism 182 and hence the suction devices 181 is accomplished through a drive mechanism 195 powered by a power drive 186 connected thereto. As seen, the drive 186 includes an eccentric arm 187 that when rotated about an axis lifts the link 188 and hence the bar 183 upwardly. The bar 183 and the suction devices 181 thereon are rotated through the use of a cam slot and cam follower 189, 190 respectively. As described above, a plurality of magazines 124 may be utilized along the length of the conveyor system 39.

There has been shown and described several embodiments of an apparatus for assembling digital storage media carriers into carrier assemblies. Many changes, modifications, variations and other uses and applications of the present construction will have or become apparent to those skilled in the art after considering the specification and the accompanying drawings. All such changes, modifications, variations and other uses and applications which do not depart from the spirit and scope of the present invention are deemed to be covered by the present invention which is limited only by the claims which follow:

The invention claimed is:

1. Apparatus for assembling a plurality of storage media carriers into a single assembly, the apparatus including:

a first magazine adapted to retain a plurality of carriers in a stack;

a carrier depositor associated with the magazine for individually releasing a lower-most positioned carrier from said magazine;

a conveyor system having at least a first conveyor adapted to receive carriers from the magazine as released by said depositor and to convey a plurality of carriers therealong in a row having a longitudinal axis;

a glue depositor operable to deposit glue on said carriers as they are conveyed along the conveyor;

a source adapted to contain a plurality of cover strips;

an applicator adapted to position and support a cover strip from the source in overlying and spaced relation to an upwardly facing surface portion of each of a plurality of said carriers on the outside surface of each carrier prior to contact with the glue thereon, the cover strip to be applied has a longitudinal axis generally parallel to the longitudinal axis of the row of carriers and generally parallel to the direction of movement of the first conveyor;

a drive member movable generally in the direction of the longitudinal axis and in an indexed manner with the first conveyor and at least one carrier thereon and operable to selectively move a respective cover strip to a position for engagement with at least one underlying carrier downstream of said glue depositor; and a spacer mechanism adapted to space the carriers in a sequence at predetermined locations from one another along a first conveyor portion prior to application of a respective cover strip to said at least one carrier at the applicator.

2. An apparatus as set forth in claim 1 wherein the conveyor system is operable to move the carriers in a generally straight line from the magazine and through the glue depositor and applicator.

3. An apparatus as set forth in claim 2 wherein the spacer mechanism includes a plurality of ears mounted to said first conveyor and spaced apart along at least a portion of the length of the first conveyor, said ears being adapted to engage an edge of a respective carrier and thereby spacing said carriers at said predetermined locations along an upper run of the first conveyor.

4. An apparatus as set forth in claim 3 wherein said ears are adapted to engage a respective trailing edge of a respective carrier to push said carriers in the direction of movement of the upper run of the first conveyor carrying said carriers at least some of said ears having a height less than the thickness of the carriers and at least some of said ears having a height greater than the thickness of the carriers.

5. An apparatus as set forth in claim 2 wherein the conveyor system includes a second conveyor positioned to receive released carriers thereon and operable to transfer released carriers to the first conveyor.

6. An apparatus as set forth in claim 5 wherein the spacer mechanism includes a plurality of ears mounted on the second conveyor and operable to engage a respective trailing edge of a carrier to fix the positions of the carriers relative to the second conveyor and to carriers in a group of carriers, said group of carriers being adapted to be attached to a respective cover strip.

7. An apparatus as set forth in claim 6 wherein said second conveyor includes at least two conveyor tracks with at least a portion of each conveyor track positioned outside of a respective side edge of the first conveyor.

8. An apparatus as set forth in claim 7 including a control device operable to control the time of release of a lower-most carrier in relation to the position of a respective said ear.

9. An apparatus as set forth in claim 8 including an airflow device operable to induce a pressure differential across top and bottom surfaces of a lower-most positioned carrier, said airflow device having an inlet end positioned below at least a portion of an upper run of each of the at least two conveyor tracks to prevent said airflow device from contacting carriers on the second conveyor.

10. An apparatus as set forth in claim 1 wherein the carrier depositor includes a first mechanism to assist gravity induced downward movement of a lower-most positioned carrier in the magazine.

11. An apparatus as set forth in claim 10 wherein the first mechanism includes an airflow device operable to induce a pressure differential across top and bottom surfaces of a lower-most positioned carrier.

12. An apparatus as set forth in claim 11 wherein the airflow device includes a negative pressure applicator positioned beneath said magazine and operable to reduce the atmospheric pressure below a lower-most positioned carrier.

13. An apparatus as set forth in claim 12 wherein the carrier depositor includes at least one power operated extendable and retractable finger selectively underlying a lower-most positioned carrier to selectively prevent downward movement of the lower-most positioned carrier and when retracted, release said lower-most positioned carrier for downward movement thereof to the conveyor system.

14. An apparatus as set forth in claim 13 wherein the carrier depositor includes a carrier retainer operable to prevent the carriers above a lower-most positioned carrier from being released to the conveyor when a lower-most carrier is released.

15. An apparatus as set forth in claim 14 wherein the carrier retainer includes a foot connected to a drive operable to selectively move said foot into and out of engagement with at least one carrier positioned above the lower-most positioned carrier during at least a portion of the time the lower-most carrier is being released from the first magazine.

16. An apparatus as set forth in claim 1 including a mechanism adapted to prevent glue from trailing at the glue depositor after deposition on a carrier as the carrier moves from the glue depositor.

17. An apparatus as set forth in claim 16 wherein the mechanism includes a source of hot air directed at a glue outlet on the glue depositor.

18. An apparatus as set forth in claim 2 wherein said drive member includes a shoulder forming member moveable with said first conveyor and adapted to engage a trailing edge of a carrier strip.

19. An apparatus as set forth in claim 18 wherein said applicator includes at least one support operable to receive a cover strip thereon and to support the cover strip during movement along the first conveyor while overlying and being spaced from at least one respective carrier therebelow preventing contact between the glue on a carrier and the cover strip during a portion of movement of the carriers and cover strip along the first conveyor.

20. An apparatus as set forth in claim 19 wherein said at least one support includes a pair of rails, each positioned adjacent an opposite side of the first conveyor for engaging and supporting opposite sides of a cover strip.

21. Apparatus for assembling a plurality of storage media carriers into a single assembly, the apparatus including:

a first magazine adapted to retain a plurality of carriers in a stack;

a carrier depositor associated with the magazine for individually releasing a lower-most positioned carrier from said magazine in a front face down orientation;

a conveyor system having at least a first conveyor adapted to receive carriers from the magazine as released by said depositor and to convey a plurality of carriers therealong in a row having a longitudinal axis, said conveyor having an upper run with an exposed generally upward facing surface for receiving deposited carriers thereon, said conveyor having an infeed end and an outfeed end;

a glue depositor downstream of the depositor operable to deposit glue on said carriers as they are conveyed along the conveyor;

a source downstream of the depositor adapted to contain a plurality of cover strips;

an applicator downstream of the depositor adapted to position and support a cover strip from the source in overlying and spaced relation to generally upwardly facing backs of a plurality of said carriers on the outside surface of each carrier prior to contact with the glue thereon, the cover strip to be applied has a longitudinal axis generally parallel to the longitudinal axis of the row of carriers and generally parallel to the direction of movement of the first conveyor; and a drive member movable generally in the direction of the longitudinal axis and in an indexed manner with the first conveyor and at least one carrier thereon and operable to selectively move a respective cover strip to a position for engagement with at least one underlying carrier downstream of said glue depositor.

22. An apparatus as set forth in claim 21 including a spacer mechanism adapted to space the carriers in a sequence at predetermined locations from one another along a first conveyor portion prior to application of a respective cover strip to carriers at the applicator.

23. An apparatus as set forth in claim 22 wherein the conveyor system is operable to move the carriers in a generally straight line from the magazine and then through the glue depositor and applicator.

* * * * *

UNITED STATES PATENT AND TRADEMARK OFFICE

CERTIFICATE OF CORRECTION

PATENT NO. : 7,089,712 B2
APPLICATION NO. : 10/709617
DATED : August 15, 2006
INVENTOR(S) : Keith Andrew Talbot It is certified that error appears in the above-identified patent and that said Letters Patent is hereby corrected as shown below:

Col. 5, line 43, delete “761” and replace with -- 76I --

Col. 5, line 44, delete “760” and replace with -- 76O --

Col. 5, line 56, delete “761” and replace with -- 76I --

Signed and Sealed this

Twelfth Day of December, 2006

JON W. DUDAS
*Director of the United States Patent and Trademark Office*